US005333672A

United States Patent [19]

Gelfgat et al.

[11] Patent Number: 5,333,672

[45] Date of Patent: Aug. 2, 1994

[54] METHOD AND DEVICE FOR PRODUCING HOMOGENEOUS ALLOYS

[75] Inventors: Yuri Gelfgat, Beer Sheva; Arie El-Boher, Metar; Herman Branover, Omer, all of Israel

[73] Assignee: Ontec, Ltd., Beer-Sheva, Israel

[21] Appl. No.: 980,563

[22] Filed: Nov. 23, 1992

[30] Foreign Application Priority Data

Nov. 24, 1991 [IL] Israel ..... 100136

[51] Int. Cl.[5] ..... B22D 27/02

[52] U.S. Cl. ..... 164/468; 164/504

[58] Field of Search ..... 164/468, 504

[56] References Cited

U.S. PATENT DOCUMENTS 4,158,380 6/1979 Sasaki et al. ..... 164/468

4,478,273 10/1984 Hanas ..... 164/468

*Primary Examiner*—Kuang Y. Lin

*Attorney, Agent, or Firm*—McAulay Fisher Nissen Goldberg & Kiel

[57] ABSTRACT

There is provided a device and a method for continuous casting of a homogeneous alloy consisting of immiscible metals. The device includes a crystallizer, fillable with a melt prepared from the metals, a homogenizer, a crystallizer, a feeder for passing a D.C. current through the melt in the crystallizer, in order to produce therein an electric field of predeterminable intensity. There is also provided an electromagnet adapted to produce therein a magnetic field of predeterminable induction, a nozzle adapted to direct jets of a coolant at selected regions of the crystallizer to cause the melt to solidify, and a puller to extract solidified portions of the alloy melt from the crystallizer. The electric field and the magnetic field are applied thereto so as to cross one another, and the interaction between the electric field produced by the D.C. current passing through the melt and the magnetic field produced by the electromagnet modify the effect of gravity, producing an indifferent equilibrium of the components of the alloy.

16 Claims, 3 Drawing Sheets

METHOD AND DEVICE FOR PRODUCING HOMOGENEOUS ALLOYS

The present invention relates to a method for producing homogeneous alloys from immiscible metals. It also relates to a device for carrying out this method.

Such alloys, which are of considerable interest for the mechanical and electrical industries as well as for aviation, etc., include composites of Al-Pb, Zn-Pb, Bi-Ga, and others. Under normal circumstances, these pairs are considered non-alloyable, because of the large differences of density of the metals making them up, which, upon solidification, produce liquational sedimentation, with the heavier metal largely settling out at the bottom of the mold.

A number of attempts were made to overcome this problem, starting from what is, at least theoretically, the simplest method, namely, the preparation of these alloys in space, on spaceships or orbital stations, under conditions of zero gravity. While producing good results, this method, at least for the present, is clearly unfeasible for quantities larger than experimental.

Other methods use high-speed cooling, breaking-up precipitated particles using ultrasound; powder-metallurgical proceedings; granulators that produce fine granules that are then pressed and rolled into sheets.

All these and similar methods suffer from the serious disadvantage in that they require complex and expensive equipment and a multi-stage technology. They also fail to produce alloys that are homogeneous, fine-grained and have a high content of the dispersed phase. They furthermore fail to produce alloys of uniformly high and reproducible qualities.

It is one of the objects of the present invention to provide a method that is essentially simple, requires no complex and expensive equipment and produces alloys that are homogeneous, may contain a high, fine-grained proportion of the dispersed phase, and are of a uniformly high, reproducible quality.

According to the invention, this is achieved by providing a method for producing homogeneous alloys from immiscible metals comprising the steps of melting down the components of said alloy by heating them in a crucible to at least the temperature required for the formation of a molecular solution and pouring said molten components into a homogenizer and crystallizer unit; maintaining said temperature at least until said components are fully homogenized; simultaneously applying to the melt a D.C.-current-generated electric field and a magnetic field of predetermined intensities, which fields are oriented to cross one another, to the effect of agitating and homogenizing said melt on the one hand, and modifying the effect of the gravitational force acting on said components, on the other, and cooling down said melt, at a predetermined rate, to the solidification temperature thereof, while maintaining said crossed electric and magnetic fields.

The invention furthermore provides a device for continuous casting of a homogeneous alloy consisting of immiscible metals, comprising crystallizer means having two ends and being fillable with a melt prepared from said metals; homogenizer means incorporated in, and communicating with, said crystallizer; feeder means located on either end of said crystallizer means for passing a D.C. current through the melt in said crystallizer means to produce therein an electric field of predeterminable intensity; at least one electromagnet having pole pieces straddling said crystallizer means and adapted to produce therein a magnetic field of predeterminable induction; nozzle means adapted to direct jets of a coolant at selected regions of said crystallizer to cause said melt to solidify within a predeterminable period of time, and puller means to extract solidified portions of said alloy melt from said crystallizer; wherein said electric field and said magnetic field cross one another, and wherein the interaction between the electric field produced by said D.C. current passing through said melt, and the magnetic field produced by said at least one electromagnet modifies the effect of gravity, producing an indifferent equilibrium of the components of said alloy, thus preventing the liquational sedimentation, due to gravity, of the heavier one of the metals constituting said alloy.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
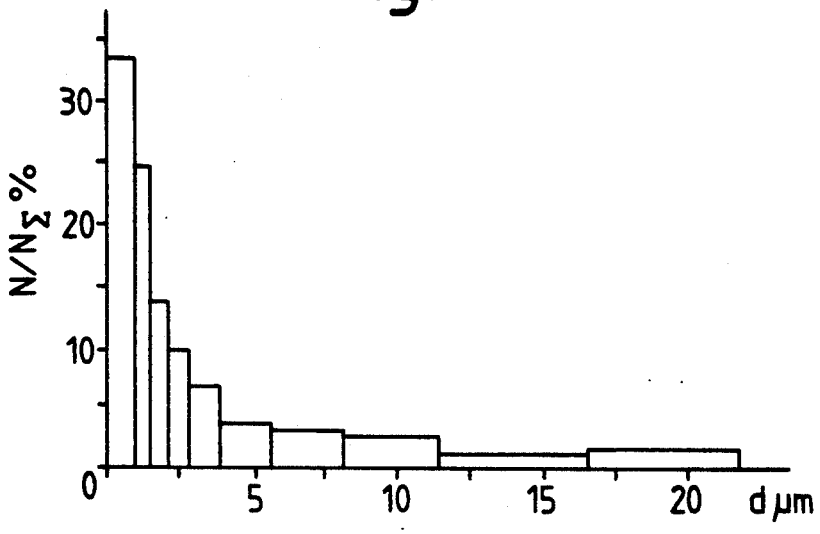
FIG. 1 shows the particle size distribution of lead particles in an aluminum-lead alloy (Al-12% Pb)

In the following description, parameters are used for explanatory purposes and the units for the parameters used as are follows:

$\sigma_{m3}, \sigma_p = (\text{ohm} \cdot \text{m})^{-1}$ $\rho_{m3}, \rho_p = \text{kg/m}^3$ $B = T$ (Tesla)

$t_c = \text{sec}$ $E = \text{V/m}$ (Volts per meter).

The method according to the invention is based on producing, in the molten mass, an indifferent equilibirum of the components by the interaction of an electric field and a magnetic field crossing one another, the parameters of these fields being precalculated to fit the respective densities and electrical conductivities of the alloy components in question, the basic condition to be attained being the equality, or near-equality, of the respective total sums of the forces (gravitational-$\rho g$ and electromagnetic jB) acting on each of the components, thus $$\rho_m g + j_m B \approx \rho_p g + j_p B$$

where $\rho_m$, $\rho_p$ = densities of the matrix and the dispersed component, respectively g = gravitational acceleration B = magnetic field induction.

The following is a detailed step-by-step description of an example of the method according to the invention.

a. The components of the alloy are melted down in a crucible, heating them to the temperature required for the formation of a molecular solution (i.e., above the critical point) with intensive mixing being effected by the high-frequency induction coil that heats the contents of the crucible.

b. The melt is then poured into a homogenizer and crystallizer unit (to be explained in detail further below), where as a first step homogenization, initiated in the crucible, is continued and intensified by keeping the temperature at the same level with the aid of a heat source, e.g., high-frequency induction coils surrounding the homogenizer. Simultaneously, the melt is exposed to the interaction of a D.C.-current-generated electric field and a magnetic field crossing one another, that produces not only intensive mixing vortices, but also force vectors which modify the effect of gravity and, provided the parameters of these fields are maintained at their proper values, permit crystallization to take place in an environment of indifferent equilibrium of the alloy components.

These electric and magnetic field parameters are determined by the expression $$EB = \frac{g(\rho_m - \rho_p)(\sigma_m + 0.5\sigma_p)}{(\sigma_p - \sigma_m)\sigma_m} \quad (1)$$

where

E = intensity of electric field, applied to the melt (V/m)

B = magnetic field induction, the vector of which is perpendicular to the E vector (T)

$\rho_m$, $\sigma_m$ = density and electric conductivity of the matrix component respectively $\rho_p$, $\sigma_p$ = density and electric conductivity of the dispersed component g = gravitational acceleration.

If the value of EB, calculated with the above expression, carries a negative sign (in case $\rho_m < \rho_p$, $\sigma_p < \sigma_m$) the electromagnetic force must act in a direction opposite to the force of gravity to achieve the condition of indifferent equilibrium while a positive sign ($\rho_m > \rho_p$, $\sigma_p > \sigma_m$) requires the electromagnetic force to act codirectionally with the gravitational force.

c. While maintaining the electric and magnetic fields, the fully homogenized melt is cooled down to the solidification temperature, taking into account that the particle size of the dispersed inclusions depends on the speed of particle coagulation of the dispersed phase which, in its turn, is determined only by the thermo-physical properties of the substances. Therefore, in order to obtain a mean particle size of the dispersed phase that is not in excess of the predetermined value, cooling must be carried out according to the relationship:

$$v > \frac{(T_{cm} - T_{kp})}{nd} \quad (2)$$

where d = mean size of the dispersed phase particles, (μm)

n = empirical coefficient equal to $3 \leqq n \leqq 30$ sec/μm v = cooling rate of melt, (degrees/sec)

$T_{cm}$ = temperature of the melt at which the components are in a state of molecular solution, ° C.

$T_{kp}$ = crystallization temperature of the melt, ° C.

Liquational sedimentation of the components may also take place as a result of the action of the magnetic field produced by the D.C. current, which influences the particles of the dispersed phase. To prevent this harmful effect, the mean density of the current which traverses the melt is selected in correspondence with ingot size, melt cooling time and the volumetrical proportion of the dispersed component particles in the melt in accordance with the following correlation:

$$j = \sigma_m E < \frac{3 \cdot 10^5}{a^{0.44}(W_o t_c)^{0.68}} \quad (3)$$

where j = mean density of the electric current traversing the melt, (A/m²)

a = size of a solidified ingot in the direction perpendicular to the E and B vectors, (m)

$W_o$ = volumetric proportion of the dispersed component in the melt (<1)

$t_c$ = cooling time of melt - time elapsed between initial pouring and the solidification of the matrix component.

Analogically, to prevent the appearance, during cooling, of liquational phenomena as well as particle enlargement of the dispersed phase owing to the appearance of additional convectional flows, the accuracy of the relationship between the mean density of the current transversing the melt and the value of the magnetic field induction must be maintained in accordance with the correlation:

$$\Delta j/j + \Delta B/B < \frac{0.338}{(W_o t_c)^{\frac{1}{3}}} \quad (4)$$

where

Δj and ΔB are the respective deviations, in the solidifying melt, of j and B from the optimum value.

Example

Melts of two immiscible metals, Al and Pb, containing between 5% and 25% percent by weight Pb, were used in one of a series of experiments. The above components were selected with a view to the differences between their mechanical and physical properties, which facilitated the easy observation of the micro-and macro-structure of the ingots produced. These alloys were intended for use as antifriction material.

The method steps explained above were carried out using the device described further below, with the magnetic and electric field parameters established in accordance with expressions (1) and (3), and the cooling regime, with expression (2).

Thus, to produce an alloy with a predetermined mean particle diameter of the dispersed phase of not more than d = 10 μm ($T_{cm}$ = 1040° C.; $T_{kp}$ = 658° C.; n = 10 sec/μm), the required cooling rate must be $v \geqq 4°$ C./sec. Consequently, using the magnetic field induction value B = 0.3T, the current density value was established according to (1) with (3) taken into account, and was equal to $j=3.3\ 10^5 A/m^2$.

During the cooling stage the actual values of j and B were monitored and, compared to the rated values calculated from expression (4), were seen to deviate by ±5% for the magnetic field, and by ±8% for the current.

As borne out by the result of the experiments and with the above-mentioned conditions strictly adhered to, the melt samples were seen to have an identical percentage distribution of lead contents (12% by weight) throughout the entire volume of the ingot and an identical dispersion of lead inclusions in aluminum. Mean particle diameter was determined according to metallographic specimen and was equal to 9 μm.

Figure 2:
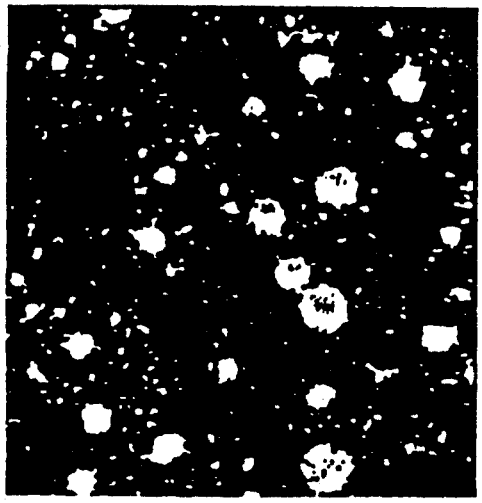
FIG. 2 shows the microstructure of the above alloy (x 400)

The particle size distribution in the Al-12% Pb alloy produced is shown in the histogram of FIG. 1, while the micro-structure of this sample can be seen in FIG. 2.

Whenever, in the experiments, the precision of the prescribed parameters of the electromagnetic and heat treatment failed to meet the requirements defined in the description, the distribution of the lead particles throughout the volume of the ingot was non-uniform, and particle size deviated from the predetermined one.

It should be noted that the method according to the invention can be used both for batch or single-piece casting, as well as for continuous casting.

Figure 3:
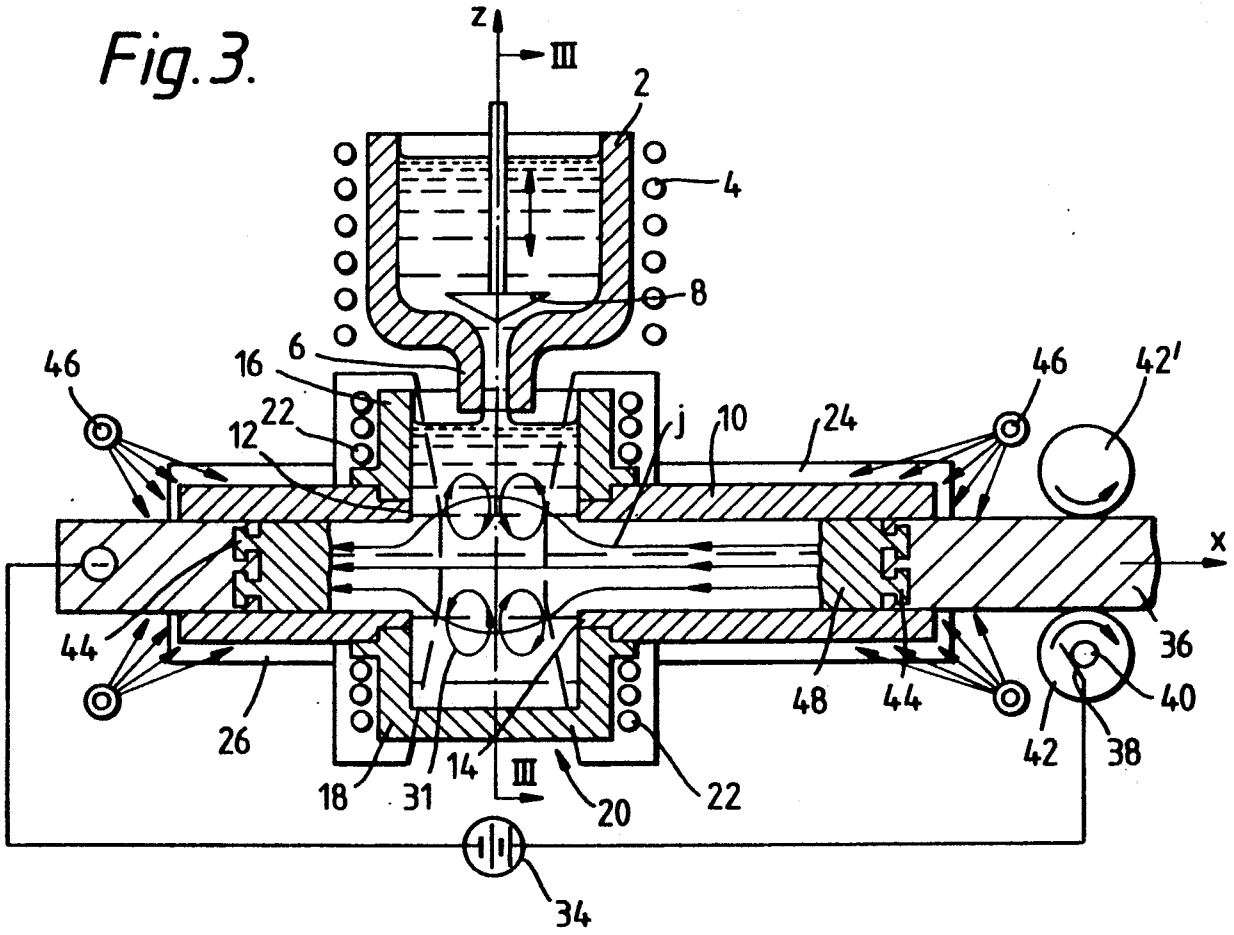
FIG. 3 is a view in longitudinal cross-section, of the device according to the invention.
Figure 4:
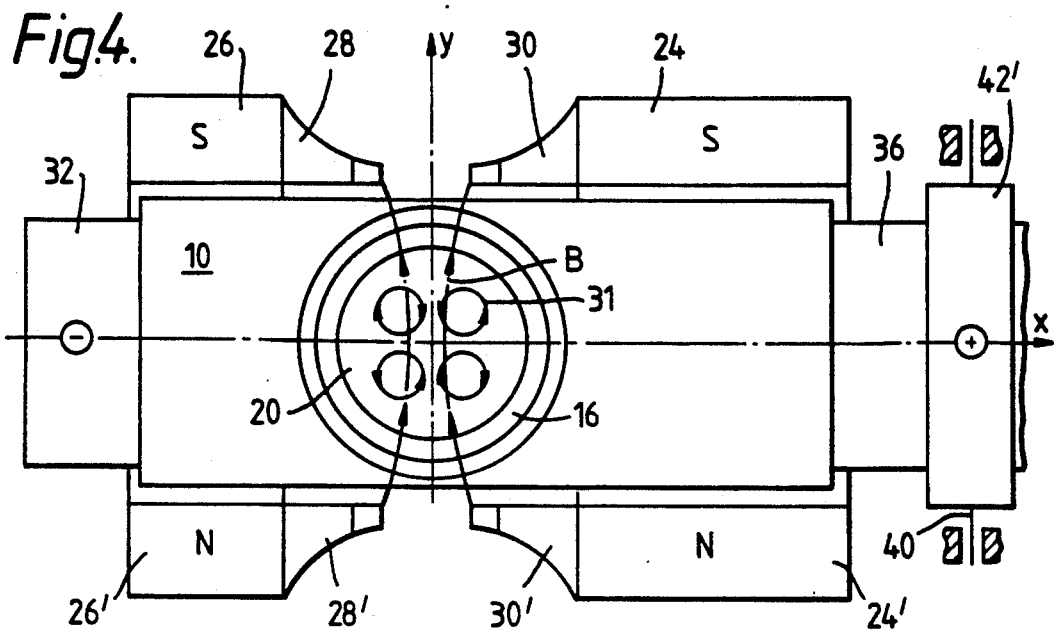
FIG. 4 is a top view of the device of FIG. 3 (with the crucible removed)
Figure 5:
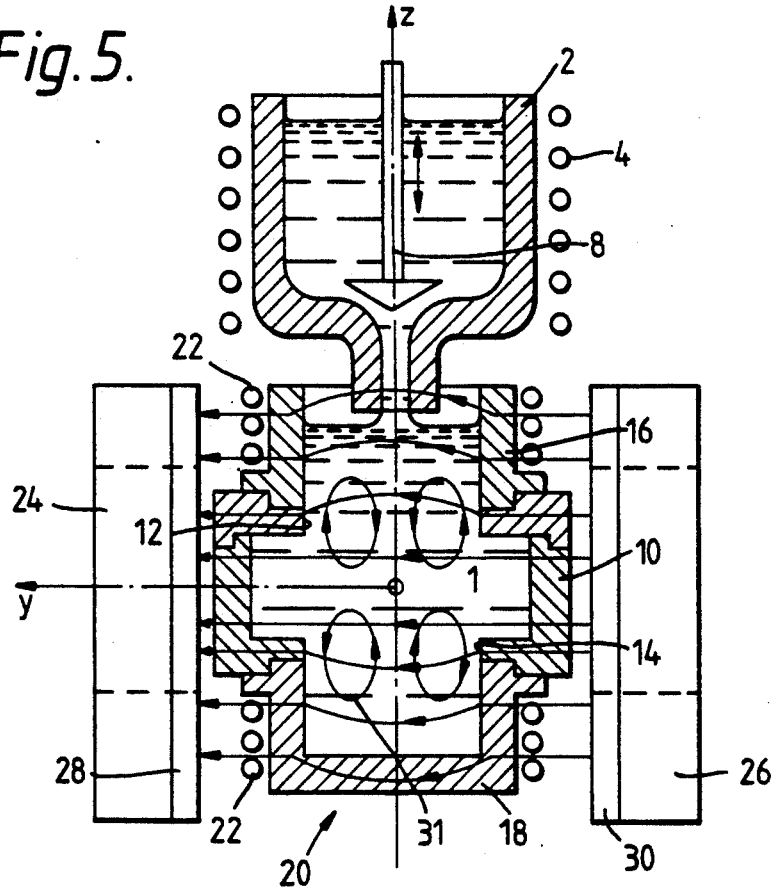
FIG. 5 is a view, in cross-section along plane III—III of FIG. 3.

The device illustrated in FIGS. 3 to 5 is designed for continuous casting and embodies the principles explained in conjunction with the above method.

In the cross-sectional longitudinal view of FIG. 3, there is seen a crucible 2 for melting down the alloy components, a high-frequency induction coil 4 surrounding the crucible 2, a spout 6 that serves as an outlet for the melt and a valve-like shutter 8 to control outflow. The crucible 2 can be an integral component of the device, hermetically attached thereto, but could also be a separate unit mounted independently of the rest of the device.

Below the crucible 2 there is shown the crystallizer 10, an elongated, horizontally oriented, hollow structure of, in this embodiment, a substantially rectangular cross-section (see FIG. 5) and made of a heat-resistant, non-corroding material such as, e.g., graphite. The crystallizer 10 is open at both ends. The inside walls of the crystallizer are advantageously coated with an electrically nonconductive material.

In substantial alignment with the crucible 2, the crystallizer 10 is provided with an upper aperture 12 and a lower aperture 14 which are respectively aligned with an upper sleeve 16 and a lower cup 18, both flanged onto the crystallizer 10 and constituting together a homogenizer vessel 20 (FIGS. 3 and 5). Both the sleeve 16 and the cup 18 are provided with induction coils 22 as a heat source.

The crystallizer 10 and the homogenizer 20 are located between the poles 24, 24' and 26, 26' and their respective pole pieces 28, 28' and 30, 30' of two electromagnets, the yokes, exciter coils, etc. of which are not shown for the sake of clarity. The pole pieces 28, 28' and 30, 30', covering the entire height of the homogenizer 20, have slanting edges (see dashed lines in FIG. 3) that define a relatively narrow clearance between the pole pieces 28, 28' and 30, 30' at the central region, which clearance widens towards the upper and lower ends of the pole pieces, shaping the magnetic field B produced between the respective poles when the electromagnets are switched on, and imparting it three components $B_x$, $B_y$ and $B_z$.

In analogy, the "ballooning" of the electric current flux lines j within the homogenizer 20 produces the components $j_x$ and $j_z$. As a result of the interaction of the magnetic and electric components, vortices 31 appear, causing the melt to move in the xz, xy and zy planes, thereby enhancing homogeneity and the uniform distribution of the dispersed component particles in the matrix component.

As explained in conjunction with the method according to the invention, the force modifying the effect of gravity depends on the interaction of a magnetic and an electric field. The magnetic field B and the means for its generation have been discussed above. The electric field E, indicated by the current flux lines j, is produced by passing a D.C. current through the melt along the crystallizer 10. To this end, there are provided two current feeders: a permanent, stationary feeder 32 on the left, permanently connected to a D.C. source 34, which feeder 32 also plugs up the open left-hand end of the crystallizer 10, and a movable start-up feeder 36 initially plugging up the open right- hand end of the crystallizer 10. Connection with the D.C. source 34 is effected via a brush-type contact 38 which bears against the journal 40 of a pulling roller 42 that is pressed against the feeder 36. Contacts can obviously be also of other designs.

Intimate contact between the current feeders 32, 36 and the melt is ensured by undercut, T-slot-like recesses 44 provided at the feeder ends facing the melt, which recesses, at the onset of the process, are filled by the molten metal that, upon solidification, shrinks and thus provides sufficient contact pressure.

At this point it should be mentioned again that the device according to the invention is designed for continuous casting which means that solid pieces of the two alloy partners, in the proper weight ratio, are continuously melted down in the crucible 2, poured into the homogenizer 20, and the solidified alloy is continuously withdrawn from the crystallizer 10. Solidification, as already explained in conjunction with the method, is effected by a controlled cooling-down produced by water-spraying nozzles 46.

Solidification having been initiated, the pulling roller pair 42, 42' starts rotating, pulling the start-up feeder 36 and, together with it, the already solidified end 48 of the cast alloy which is strongly interlocked with the feeder 36. As soon as the end of the feeder 36 has been pulled past the rollers 42, 42', its function both as current feeder and as puller is taken over by the solidified portion of the alloy which is now in both electrical and friction contact with the pulling roller pair 42, 42'.

The cross-section of the bar produced is, of course, a function of the outlet cross-section of the crystallizer 10.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for producing homogenous alloys from immiscible metals, comprising the steps of:

melting down the components of said alloy by heating them in a crucible to at least the temperature required for the formation of a molecular solution and pouring said molten components into a homogenizer unit and crystallizer communicating with each other unit;

maintaining said temperature at least until said components are fully homogenized;

simultaneously applying to the melt in said homogenizer unit and said crystallizer unit a D.C.-current-generated electric field and a magnetic field of predetermined intensities, which fields are oriented to cross one another, to the effect of agitating and homogenizing said melt in said homogenizer unit on the one hand, and modifying the effect of the gravitational force acting on said components, on the other, and cooling down said melt, at a predetermined rate, to the solidification temperature thereof and withdrawing the solidified alloy from the crystallizer unit, while maintaining said cross electric and magnetic fields.

2. The method as claimed in claim 1, wherein both said melting-down process and said solidification process are continuous processes, the separate components of said alloy being continuously introduced into said crucible, and the solidified alloy being continuously withdrawn from said crystallizer.

3. The method as claimed in claim 1, wherein the parameters of the electric and magnetic fields are determined according to the expression:

$$EB = \frac{g(\rho_m - \rho_p)(\sigma_m + 0.5\sigma_p)}{(\sigma_p - \sigma_m)\sigma_m} \quad (1)$$

where

E=intensity of electric field, applied to the melt (V/m)

B=magnetic field induction, the vector of which is perpendicular to the E vector (T)

$\rho_m$, $\sigma_m$=density and electric conductivity of the matrix component respectively $\rho_p$, $\sigma_p$=density and electric conductivity of the dispersed component g=gravitational acceleration.

4. The method as claimed in claim 1, wherein said cooling rate is determined according to the expression:

$$v > \frac{(T_{cm} - T_{kp})}{nd} \quad (2)$$

where d=mean size of the dispersed phase particles, (μm)

n=empirical coefficient equal to $3 \leqq n \leqq 30$ sec/μm v=cooling rate of melt, (degrees/sec)

$T_{cm}$=temperature of the melt at which the components are in a state of molecular solution, ° C.

$T_{kp}$=crystallization temperature of the melt, ° C.

5. The method as claimed in claim 1, wherein the mean density of the current producing said electric field by passing through said melt is determined according to the expression:

$$j = \sigma_m E < \frac{3 \cdot 10^5}{a^{0.44}(W_o t_c)^{0.68}} \quad (3)$$

where j=mean density of the electric current traversing the melt, (A/m²)

a=size of a solidified ingot in the direction perpendicular to the E and B vectors, (m)

$W_o$=volumetric proportion of the dispersed component in the melt (<1)

$t_c$=cooling time of melt - time elapsed between initial pouring and the solidification of the matrix component.

6. The method as claimed in claim 1, wherein the accuracy of the correlation between the mean current density in the melt and the magnetic field is maintained according to the expression:

$$\Delta j/j + \Delta B/B < \frac{0.338}{(W_o t_c)^{\frac{1}{4}}} \quad (4)$$

where

Δj and ΔB are the respective deviations, in the solidifying melt, of j and B from the optimum value.

7. A device for continuous casting of a homogeneous alloy consisting of immiscible metals, comprising:

crystallizer means having two ends and being fillable with a melt prepared from said metals;

homogenizer means incorporated in, and communicating with, said crystallizer;

feeder means located on either end of said crystallizer means for passing a D.C. current through the melt in said crystallizer means to produce therein an electric field of predeterminable intensity;

at least one electromagnet having pole pieces straddling said crystallizer means and adapted to produce therein a magnetic field of predeterminable induction;

nozzle means adapted to direct jets of a coolant at selected regions of said crystallizer to cause said melt to solidify within a predeterminable period of time, and puller means to extract solidified portions of said alloy melt from said crystallizer, wherein said electric field and said magnetic field cross one another, and wherein the interaction between the electric field produced by said D.C. current passing through said melt and the magnetic field produced by said at least one electromagnet modifies the effect of gravity, producing an indifferent equilibrium of the components of said alloy, thus preventing the liquational sedimentation, due to gravity, of the heavier one of the metals constituting said alloy.

8. The device as claimed in claim 7, wherein said crystallizer means is in the form of a horizontally mounted, elongated tubular structure with at least one open end.

9. The device as claimed in claim 7, wherein said homogenizer means is in the form of a vessel open at its top and traversing said crystallizer in a direction substantially perpendicular to the longitudinal extent thereof.

10. The device as claimed in claim 8, wherein said crystallizer has two open ends.

11. The device as claimed in claim 7, wherein said device comprises two electromagnets, each having two pole pieces in substantial symmetry with respect to said homogenizer.

12. The device as claimed in claim 7, wherein one of said feeders is permanent and stationary, plugging up one of said crystallizer ends, and the other one of said feeders is a start-up feeder adapted to be acted upon by said puller means.

13. The device as claimed in claim 7, wherein said puller means is in the form of a pair of rollers, at least one of which is motor-driven, between which rollers, at start-up, said start-up feeder is tightly pressed and by which it is linearly driven, extracting said alloy from said crystallizer after the solidification of said melt.

14. The device as claimed in claim 12, wherein the melt-facing ends of said feeder means are provided with undercut recesses for the melt to enter and solidify in.

15. The device as claimed in claim 7, further comprising a crucible for the melting therein of the separate metals to eventually form said alloy, said crucible being mounted above said homogenizer and having an outlet aperture controllable by valve means.

16. The device as claimed in claim 15, wherein both said crucible and said homogenizer means are provided with heater means in the form of high-frequency induction coils.

* * * * *